US009399902B2

(12) United States Patent
Greci

(10) Patent No.: US 9,399,902 B2
(45) Date of Patent: Jul. 26, 2016

(54) EXPANDABLE SCREEN COMPLETION TOOL

(71) Applicant: HALLIBURTON ENERGY SERVICES, INC., Houston, TX (US)

(72) Inventor: Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 274 days.

(21) Appl. No.: 14/118,554

(22) PCT Filed: Jan. 8, 2013

(86) PCT No.: PCT/US2013/020671
§ 371 (c)(1),
(2) Date: Nov. 18, 2013

(87) PCT Pub. No.: WO2014/109732
PCT Pub. Date: Jul. 17, 2014

(65) Prior Publication Data
US 2015/0204168 A1 Jul. 23, 2015

(51) Int. Cl.
*E21B 43/08* (2006.01)
*E21B 43/10* (2006.01)

(52) U.S. Cl.
CPC ..... *E21B 43/088* (2013.01); *E21B 43/08* (2013.01); *E21B 43/084* (2013.01); *E21B 43/10* (2013.01); *E21B 43/108* (2013.01)

(58) Field of Classification Search
None
See application file for complete search history.

(56) References Cited

U.S. PATENT DOCUMENTS 2,858,894 A * 11/1958 Akeyson ..... E21B 43/084 166/230
3,270,817 A * 9/1966 Papaila ..... E21B 43/088 166/207
5,339,895 A 8/1994 Arterbury et al.
5,355,949 A * 10/1994 Sparlin ..... E21B 43/088 166/236
5,901,789 A * 5/1999 Donnelly ..... E21B 43/04 166/207
5,979,551 A * 11/1999 Uban ..... E21B 43/088 166/231
6,006,829 A * 12/1999 Whitlock ..... B01D 29/15 166/228
6,044,906 A * 4/2000 Saltel ..... E21B 33/1277 166/187
6,263,966 B1 * 7/2001 Haut ..... E21B 29/10 166/230
6,263,972 B1 * 7/2001 Richard ..... E21B 43/082 166/230

(Continued)

FOREIGN PATENT DOCUMENTS

WO 03010021 A1 12/2003

OTHER PUBLICATIONS

Foreign Communication from a Related Counterpart Application, "International Search Report and Written Opinion" dated Sep. 16, 2013, International Application No. PCT/US13/20671 filed on Jan. 8, 2013.

(Continued)

*Primary Examiner* — Shane Bomar
(74) *Attorney, Agent, or Firm* — Scott Richardson; Baker Botts L.L.P.

(57) ABSTRACT

An expandable screen comprises a first end comprising a first coupling mechanism, a second end comprising a second coupling mechanism, a wire wrap section extending between the first end and the second end, and a plurality of rods coupled to the wire wrap section. The wire wrap section is coupled to the first and the second end, and the wire wrap section is configured to radially expand. The plurality of rods is configured to control spacing between adjacent wire edges upon radial expansion of the wire wrap section.

20 Claims, 9 Drawing Sheets

(56) References Cited

U.S. PATENT DOCUMENTS 6,543,545 B1 * 4/2003 Chatterji ..... E21B 43/04 166/207
6,568,472 B1 * 5/2003 Gano ..... E21B 43/105 166/157
6,695,054 B2 * 2/2004 Johnson ..... E21B 43/108 166/195
6,698,518 B2 * 3/2004 Royer ..... E21B 43/088 166/230
6,942,036 B2 * 9/2005 Gabrysch ..... E21B 37/10 166/207
7,048,048 B2 5/2006 Nguyen et al.
7,121,352 B2 * 10/2006 Cook ..... E21B 33/10 166/117.6
7,533,731 B2 * 5/2009 Corre ..... E21B 29/10 166/187
2002/0092648 A1 7/2002 Johnson et al.
2003/0234111 A1 * 12/2003 Echols ..... E21B 17/1014 166/382
2012/0048536 A1 3/2012 Holderman et al.
2012/0152528 A1 * 6/2012 Greci ..... E21B 43/088 166/227

OTHER PUBLICATIONS

International Preliminary Report on Patentability issued in related PCT Application No. PCT/US2013/020671, mailed on Jul. 23, 2015 (10 pages).

* cited by examiner

EXPANDABLE SCREEN COMPLETION TOOL

CROSS-REFERENCE TO RELATED APPLICATIONS

This application is a national stage of and claims priority under 35 U.S.C. §371 to International Patent Application Serial No. PCT/US13/20671, filed on Jan. 8, 2013, entitled "Expandable Screen Completion Tool," by Stephen Michael Greci, which is incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations to produce one or more fluids from the subterranean formation. For example, a wellbore may be used to produce one or more hydrocarbons. Additional components such as water may also be produced with the hydrocarbons, though attempts are usually made to limit water production from a wellbore or a specific interval within the wellbore. Other components such as hydrocarbon gases may also be limited for various reasons over the life of a wellbore. When a wellbore is completed, equipment may be placed in the wellbore to promote efficient, long term production from the wellbore. For example, sand screens may be placed in the wellbore to attenuate propagation of fines and other solid particles from the production formation into the wellbore and up the completion string. Such undesired fines may slow the production of desired hydrocarbons and/or may degrade equipment components through abrasive action.

SUMMARY

In an embodiment, an expandable screen comprises a first end comprising a first coupling mechanism, a second end comprising a second coupling mechanism, a wire wrap section extending between the first end and the second end, and a plurality of rods coupled to the wire wrap section. The wire wrap section is coupled to the first and the second end, and the wire wrap section is configured to radially expand. The plurality of rods is configured to control a spacing between adjacent wire edges upon radial expansion of the wire wrap section.

In an embodiment, an expandable screen comprises a first end, a second end, and a screen section coupled to the first end and the second end. The screen section is configured to expand in response to an outward directed force exerted on an interior of the screen section, and the expandable screen does not comprise a base pipe.

In an embodiment, a method of expanding an expandable screen in a wellbore comprises disposing an expansion tool into an interior flowbore of an expandable screen, providing an outward directed force on the interior of the screen section using the expansion tool, and radially expanding the screen section in response to the outward directed force. The expandable screen comprises a first end, a second end, a screen section coupled to the first end and the second end, wherein the expandable screen does not comprise a base pipe.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
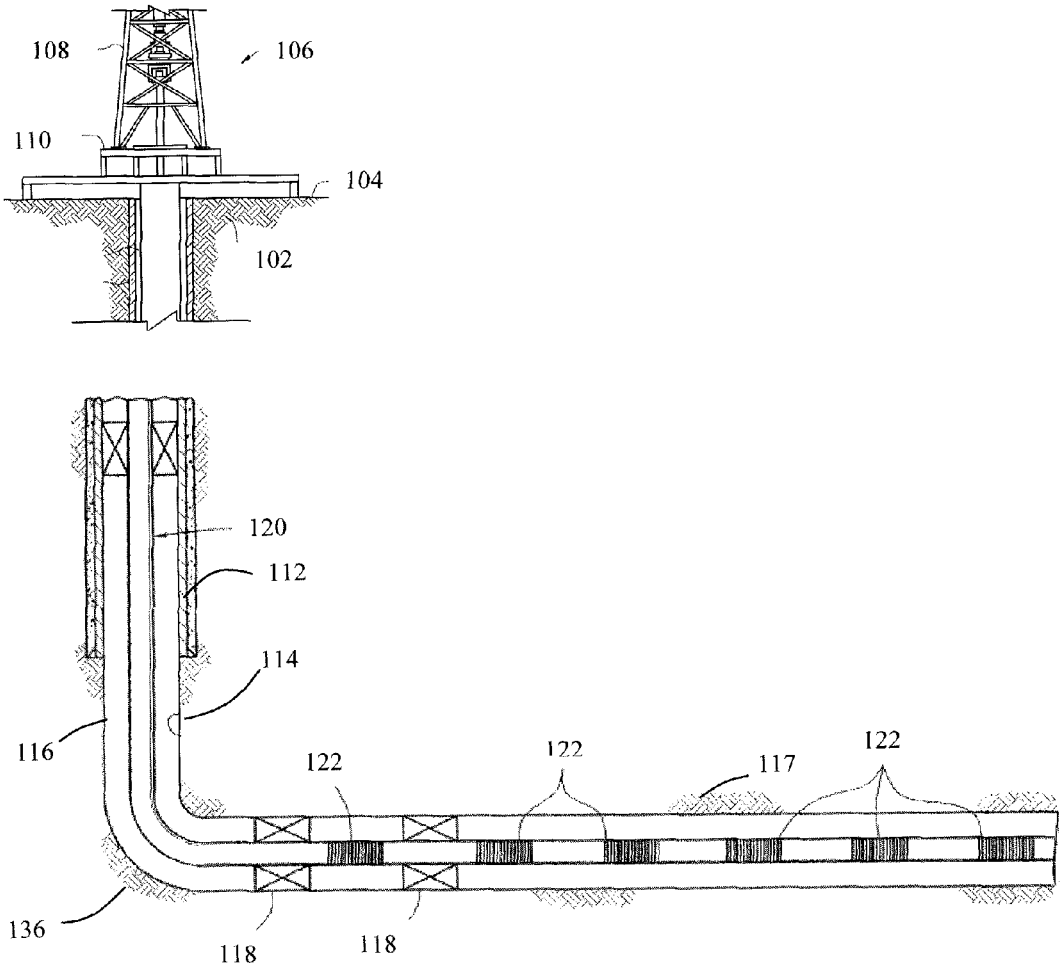
FIG. 1 is a cut-away view of an embodiment of a wellbore servicing system according to an embodiment of the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," or "upward" meaning toward the surface of the wellbore and with "down," "lower," or "downward" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclosed herein is an expandable screen that does not comprise a base pipe. Rather, the expandable screen taught by the present disclosure comprises one or more concentric expandable layers. The expandable layers may generally comprise a wire wrap and supporting rods that together form a structural screen section without the need for a base pipe. In one embodiment, the expandable screen comprises a perforated shroud disposed about the expandable. Alternate embodiments may combine one or more additional layers at various locations within the screen. The additional layers may include various filter materials such as thin metal wire matting, batting, or screen material.

The overall structure of the expandable screen may provide an increased flow area for fluid through the screen structure. In traditional screens, the flow area through the base pipe was limited to avoid reducing the structural integrity of the base pipe. The limited ability to remove material from the base pipe also resulted in a relatively heavy screen completion that had a limited degree of expansibility. The removal of the base pipe may then make the screen assembly lighter and expand to a larger degree, which may improve the ability of the screen to conform to the shape of the wellbore wall.

Referring to FIG. 1, an example of a wellbore operating environment in which a flow control device may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 117. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further, the wellbore may be used for both producing wells and injection wells.

A wellbore tubular string 120 may be lowered into the subterranean formation 102 for a variety of drilling, completion, workover, treatment, and/or production processes throughout the life of the wellbore. The embodiment shown in FIG. 1 illustrates the wellbore tubular string 120 in the form of a completion assembly string disposed in the wellbore 114. It should be understood that the wellbore tubular string 120 is equally applicable to any type of wellbore tubulars being inserted into a wellbore including as non-limiting examples drill pipe, casing, liners, jointed tubing, and/or coiled tubing. Further, the wellbore tubular string 120 may operate in any of the wellbore orientations (e.g., vertical, deviated, horizontal, and/or curved) and/or types described herein. In an embodiment, the wellbore may comprise wellbore casing 112, which may be cemented into place in the wellbore 114.

In an embodiment, the wellbore tubular string 120 may comprise a completion assembly string comprising one or more wellbore tubular types and one or more downhole tools (e.g., zonal isolation devices 118, screens, valves, etc.). The one or more downhole tools may take various forms. For example, a zonal isolation device 118 may be used to isolate the various zones within a wellbore 114 and may include, but is not limited to, a packer (e.g., production packer, gravel pack packer, frac-pac packer, etc.). In an embodiment, the wellbore tubular string 120 may comprise a plurality of well screen assemblies 122, which may be disposed within the horizontal wellbore portion 117. The zonal isolation devices 118, may be used between various ones of the well screen assemblies 122, for example, to isolate different zones or intervals along the wellbore 114 from each other.

The workover and/or drilling rig 106 may comprise a derrick 108 with a rig floor 110 through which the wellbore tubular string 120 extends downward from the drilling rig 106 into the wellbore 114. The workover and/or drilling rig 106 may comprise a motor driven winch and other associated equipment for conveying the wellbore tubular string 120 into the wellbore 114 to position the wellbore tubular string 120 at a selected depth. While the operating environment depicted in FIG. 1 refers to a stationary workover and/or drilling rig 106 for conveying the wellbore tubular string 120 within a land-based wellbore 114, in alternative embodiments, mobile workover rigs, wellbore servicing units (such as coiled tubing units), and the like may be used to convey the wellbore tubular string 120 within the wellbore 114. It should be understood that a wellbore tubular string 120 may alternatively be used in other operational environments, such as within an offshore wellbore operational environment.

Figure 2A:
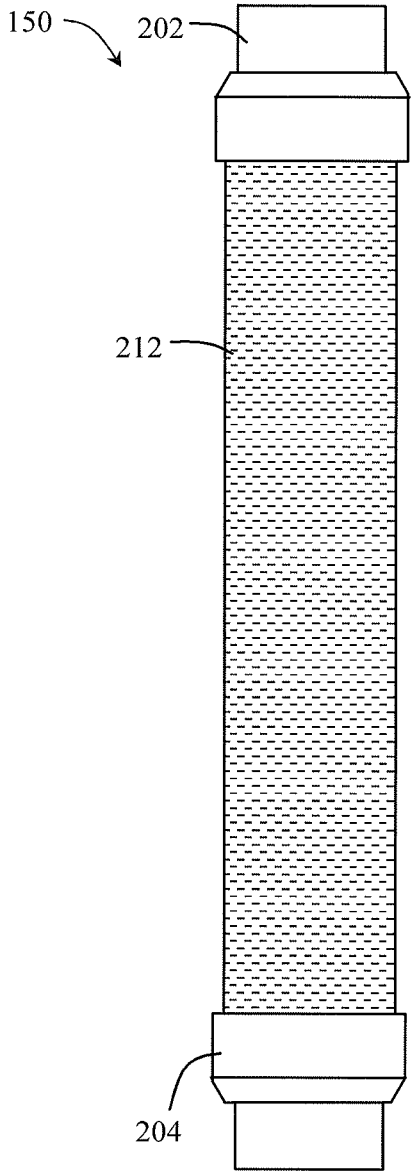
FIG. 2A is a plan view of an expandable screen according to an embodiment of the disclosure.
Figure 2B:
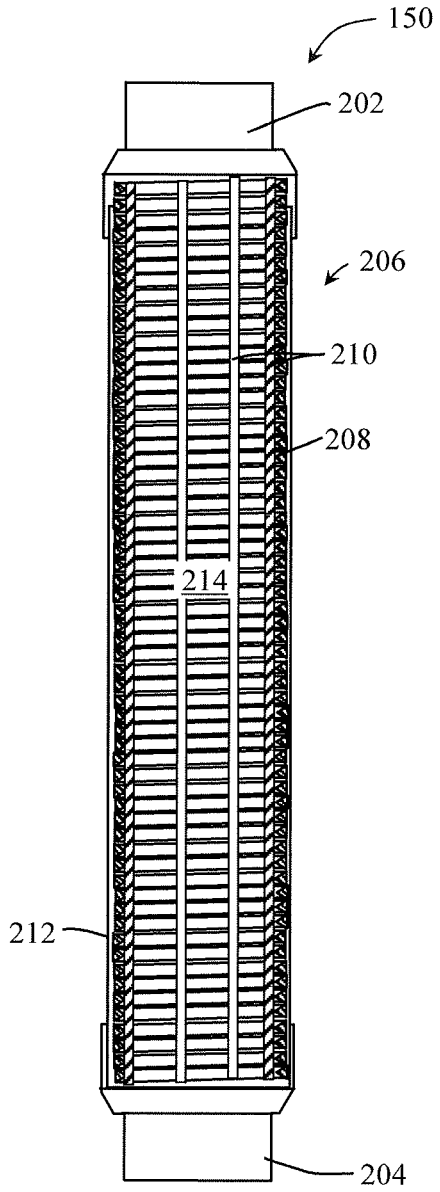
FIG. 2B is a cross-sectional view of an expandable screen according to an embodiment of the disclosure.

Turning to FIGS. 2A and 2B, an expandable screen 150 is illustrated in plan and cross-sectional views. In an embodiment, the expandable screen 150 may comprise one or more layers that promote flow of fluids from the wellbore 114 into an interior of the expandable screen 150 and upwards from there into the wellbore tubular to the surface while filtering or excluding at least some of the fines released from the subterranean formation or other debris. As illustrated in FIGS. 2A and 2B, the expandable screen 150 does not comprise a base pipe.

The expandable screen 150 comprises a first end 202 and a second end 204. The first end 202 and the second end 204 may be solid, generally cylindrical end caps, which may serve as a connection point for the expandable screen 150 to one or more adjacent components. The first end 202 and/or the second end 204 may have suitable coupling devices or means to allow the expandable screen 150 to be coupled to one or more components. For example, the first end 202 and/or the second end 204 may comprise a threaded connection for coupling to an adjacent and correspondingly threaded component such as another tool or a wellbore tubular. The first end 202 and/or the second end 204 may be coupled to the screen section 206, any additional filter elements, and/or the shroud 212 using any suitable engagement (e.g., a threaded engagement, welded, brazed, bonded, etc.). In some embodiments, the first end 202 and/or the second end 204 may be integrally formed with one or more of the screen section 206, any additional filter elements, and/or the shroud 212.

The screen section 206 may be configured to provide the structure integrity of the expandable screen 150 during conveyance of the expandable screen 150 within the wellbore and when the expandable screen 150 is expanded to engage the wellbore wall. The screen section 206 generally comprises a tubular body extending between the first end 202 and the second end 204. An internal flowbore 214 extends through the screen section 206 between the first end 202 and the second end 204, and the size of the flowbore 214 may be selected to allow fluid flow therethrough at a desired rate during normal operation of the wellbore tubular string 120. The screen section 206 comprises one or more wire wraps 208 closely wrapped helically to form a cylindrical structure with the flowbore 214 disposed therethrough. The spacing between the wire wraps 208 can be chosen to keep sand and the like that is greater than a selected size from passing between the wire wraps. The wire wraps 208 may comprise any suitable cross-sectional shape, and in an embodiment, may comprise a triangular, conical, or frusto-conical cross section, and the narrow end of the cross-section may be directed inwards. This configuration may allow for the proper spacing between adjacent wires while providing for a relatively open flow path between the adjacent wire wraps 208. The use of a screen section 206 without a base pipe may allow for a greater area for flow through the expandable screen 150. In an embodiment, at least about 5%, at least about 10%, at least about 15%, at least about 20%, at least about 25%, or at least about 30% of the area of the outer surface of the screen section 206 (e.g., the outer surface of a wire wrap) may be open to fluid flow.

The screen section 206 may also comprise one or more rods 210. The rods may be axially aligned along the wire wrap 208 and coupled to the wire wrap 208 at one or more points along the rod 210. For example, the wire wrap 208 may be welded, brazed, bonded, etc. to the rod at one or more points of contact between the wire wrap 208 and the rod 210. The rods may be disposed on the interior of the wire wrap 208 and/or on the exterior of the wire wrap 208. The rods 210 may provide the structural integrity for the expandable screen 150 in the axial direction, thereby resisting compressive and tensile loads during conveyance of the expandable screen 150 within the wellbore 114. Any number of rods 210 may be used with the screen section 206, and the number and type of rods 210 may be selected based on the expected loads on the expandable screen 150.

In an embodiment, the rods 210 may be disposed helically about the longitudinal axis of the expandable screen 150. In this embodiment, expanding the expandable screen 150 may cause the rods 210 to unwind to some degree, thereby increasing the longitudinal length of the wire wrap section as well as increasing the spacing between adjacent wire wrap edges. The initial spacing between the adjacent wire wrap 208 edges may be selected to provide the desired spacing upon expansion of the expandable screen 150. In the initial configuration, the smaller spacing between adjacent wire wrap 208 edges may aid in limiting the amount of debris capable of entering the expandable screen 150 during conveyance in the wellbore. The use of a helical configuration of the rods 210 may also limit the amount of residual stress placed on the wire wrap 208 and the rods 210 upon expansion of the expandable screen 150 within the wellbore 114.

The expandable screen 150 may comprise an outer shroud 212 to protect the screen section 206 from damage during installation of the expandable screen 150 within the wellbore, the shroud 212 may extend between the first end 202 and the second end 204 about the screen section 206. The shroud 212 comprises a generally cylindrical member formed from a durable, deformable, and high strength material such as steel, though other materials may be used in keeping with the principles of the present disclosure. The shroud 212 may have a plurality of openings (Shown schematically in FIG. 2A) through the wall thereof to provide a fluid outlet and/or a fluid inlet for fluids into the shroud 212 and through the permeable section of the wire wrap 208 during production. As is generally understood, the shroud 212 is distinct from a base pipe by being positioned about the components of the expandable screen rather than within them, is generally thinner than a base pipe (e.g., a lighter gauge), and since the shroud 212 does not structurally support the screen, the shroud 212 generally has more open area through the openings than a perforated base pipe. By positioning the shroud 212 over the screen section 206, the wire wrap 208, the rods 210, and any additional filter elements can be protected from any accidental impacts during the assembly and installation of the screen assembly in the wellbore that might otherwise severely damage or destroy one or more components of the screen assembly. In addition, when the expandable screen 150 is expanded, the shroud 212 may protect the screen section 206 from damage due to contact with the wellbore wall and provide radial support to prevent collapse of the wellbore.

Figure 3A:
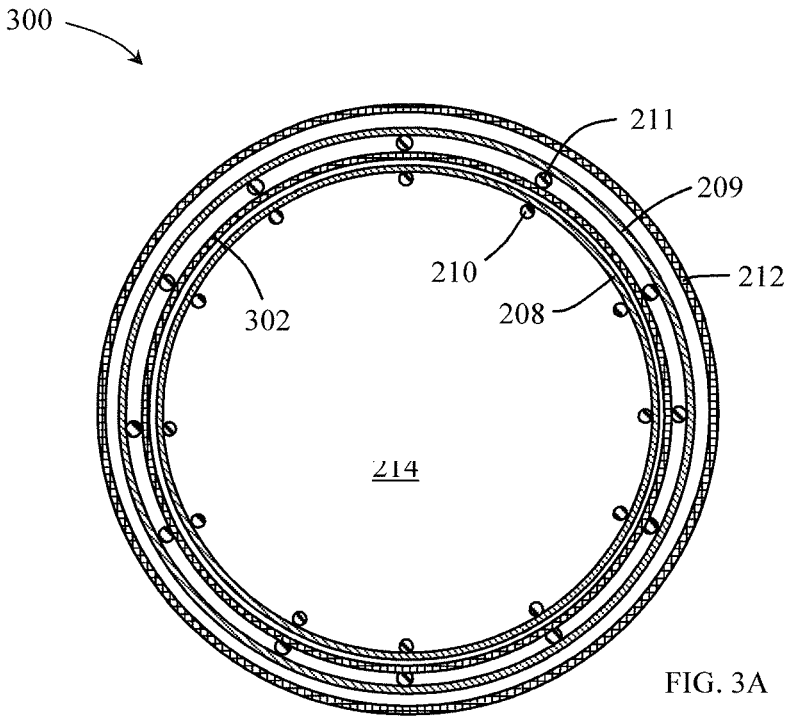
FIG. 3A is a cross-sectional view of an expandable screen according to an embodiment of the disclosure.

FIG. 3A illustrates a cross-sectional view of another embodiment of an expandable screen 300. The expandable screen 300 is similar in many respects to the expandable screen 150 described above in that the expandable screen 300 comprises an outer shroud 212 and an inner wire wrap 208 coupled to a plurality of rods 210. In addition to the shroud 212 and wire wrap 208, an additional filter layer 302 may comprise one or more additional layers of filtering material. The filter layer 302 can be used to separate at least a portion of any sand and/or other debris from a fluid that generally flows from an exterior to an interior flowbore 214 of the expandable screen 300. The filter layer 302 can include, but is not limited to, various types of filter elements such as sintered, mesh, matting, pre-packed, expandable, slotted, and/or perforated filters. For example, the filter layer 302 may comprise a woven metal material, with strands thereof sintered to each other and oriented circumferentially, axially, or helically relative to a longitudinal axis of the expandable screen 300. Sintering of the strands may improve the strength of the filter layer 302 while maintaining consistency in the spacing between the strands when the layer is radially outwardly expanded. In an embodiment, orienting the strands helically relative to the longitudinal axis of the expandable screen 300 may aid in preventing distortion of the filter layer when the layers are radially outwardly expanded. However, it is to be clearly understood that it is not necessary in keeping with the principles of the present invention for the filtering material to be made up of woven material having sintered strands oriented helically relative to the expandable screen 300 axis, since other types of filtering media maybe used in the expandable screen 300.

Upon being expanded, the filter layer 302 may be stretched circumferentially when the expandable screen 300 is radially outwardly expanded. Preferably, this stretching of the filtering material results in a change of less than fifty percent in the size of the openings for fluid flow through the filter layers. In an embodiment, the maximum size of the openings for fluid flow through the filter layer 302 may be about 500 μm. Thus, after the expandable screen 300 is radially outwardly expanded, the filter layer 302 may filter particles having a size of greater than about 500 μm from the fluid flowing therethrough.

In some embodiments, the size of the openings in the filter layer 302 may not change upon radial expansion, and the filter layer 302 may comprise one or more layers that are configured to radially expand without changing the size of the openings (e.g., the pore size). For example, the wires or material forming the filter layer 302 may stretch and/or deform to some degree without affecting the size of the openings through the filter layer 302. In an embodiment, the filter layer 302 may comprise a mesh, and the individual fibers forming the mesh may realign to some degree during radial expansion without a change or with only an insubstantial change in the pore size through the mesh. In some embodiments, a plurality of overlapping layers of filter material may be used, as described in more detail herein. In this embodiment, the radial expansion of the filter layer 302 may result in a realignment of the filter material layers without substantially deforming or stretching the individual filter material layers. The size of the openings may then be relatively unaffected while still providing for at least one filter material layer about the wire wrap 208.

In an embodiment, the filter layer 302 may comprise one or more layers of the filter material. In an embodiment, the filter layer 302 may comprise a plurality of layers of filter material. For example, the filter layer 302 may comprise one or more layers of relatively fine filtering material sandwiched between layers of relatively coarse filter material. The relatively fine filtering material may be sintered woven filtering material, which may be oriented helically relative to the expandable screen longitudinal axis. The terms "fine" and "coarse" are used herein to indicate the relative size of particles permitted to pass through the filter material layers within the filter layer 302. For example, the middle layer of filter material may filter fine or small-sized particles from fluid passing therethrough, while the inner and outer material layers may filter coarse or larger-sized particles from fluid passing therethrough. In an embodiment, the middle layer of relatively fine material may filter particles having a size of greater than about 500 μm from the fluid flowing therethrough.

In an embodiment, the inner and outer filter material layers are not necessarily used for their filtering properties, though the coarse filter material may filter larger-sized particles (e.g., particles larger than about 500 μm, about 1,000 μm, or about 1,500 μm) from fluid flowing into the expandable screen 300. Rather, the filter material layers may be used to provide an axial flow path along one or more of the wire wraps 208, 209. For example, if the coarse filter material layers are made of a relatively coarse woven material, fluid may flow in the axial direction through the layers between the inner wire wrap 208 and the outer wire wrap 209. Thus, fluid may flow into one of the openings in the shroud 212, flow radially through the outer wire wrap 209, axially and/or radially through the outer filter material layer, flow radially through a middle filter material layer, flow axially and/or radially through the inner filter material layer, and radially through the inner wire wrap 208 into the interior flowbore 214.

As illustrated in FIG. 3A, an additional screen portion may be disposed about the inner wire wrap 208 and the filter layer 302. The additional screen portion may comprise a wire wrap 209 coupled to one or more rods 211. The wire wrap 209 and rods 211 may be the same or similar to the wire wrap 208 and rods 210, only with a larger diameter. In some embodiments, the wire wrap 209 and rods 211 may provide structural support for the expandable screen 300. The rods 211 may be disposed on the inside of the wire wrap 209, though in some embodiments, the rods may be disposed outside of the wire wrap 209, thereby allowing the filter layer 302 to be disposed between the two wire wraps 208, 209. When the rods 211 are disposed on the inside of the wire wrap 209, the rods 211 may provide a channel between the filter layer 302 and the wire wrap 209. The channel may provide for an axial flow path along the length of the filter layer 302, thereby allowing for an even distribution of fluid passing through the wire wrap 209. The rods 211 may be disposed along the longitudinal axis of the expandable screen 300 and/or the rods 211 may be disposed at an angle with respect to the longitudinal axis of the expandable screen 300 (e.g., helically about the longitudinal axis of the expandable screen 300 as described herein).

As illustrated in FIG. 3A, the use of a filter layer 302 disposed between two wire wraps 208, 209 may aid in decoupling the two wire wraps during expansion. For example, the degree of expansion of each wire wrap 208, 209, and the rods coupled to the respective wire wraps 208, 209, may vary due to the different initial diameters. The presence of the filter layer 302 between the two wire wraps 208, 209 may aid in allowing for differential expansion without the direct engagement of the rods and/or wire wraps.

While illustrated in FIG. 3A as comprising two wire wraps 208, 209 and a filter layer 302 disposed there between, any number of wire wraps may be used as well as any number of filter layers. The resulting layered structure may then be optionally surrounded by the shroud.

Figure 3B:
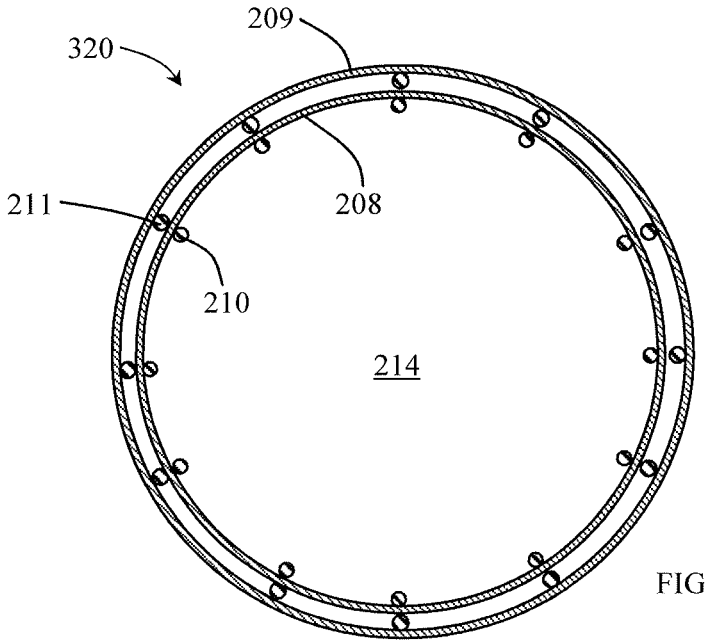
FIG. 3B is another cross-sectional view of an expandable screen according to an embodiment of the disclosure.

FIG. 3B illustrates a cross-sectional view of another embodiment of an expandable screen 320. The expandable screen 320 is similar in many respects to the expandable screen 300 described above in that the expandable screen 320 comprises an inner wire wrap 208 coupled to a plurality of rods 210 and an outer wire wrap 209 coupled to a second plurality of rods 211. However, the embodiment illustrated in FIG. 3B does not include an additional filter layer or an outer shroud. Rather than having an outer shroud, the outer wire wrap 209 may act to protect the inner wire wrap 208 during conveyance and installation of the expandable screen 320 in the wellbore. The outer wire wrap 209 may be the same or different than the inner wire wrap 208. For example, the wire wrap may comprise a different gauge wire and/or the spacing between adjacent wire edges may be the same or different. In an embodiment, the outer wire wrap 209 may comprise a lighter wire gauge and have a larger spacing between adjacent wire edges. This may allow the outer wire wrap 209 to act as a shroud and thereby protect the inner wire wrap 208 from any accidental impacts during the assembly and installation of the screen assembly as well as provide radial support to prevent collapse of the wellbore when the expandable screen 320 is in an expanded configuration.

While the outer wire wrap 209 is illustrated in FIG. 3B as being coupled to rods 211 along the inner surface of the wire wrap 209, the rods 211 may also be coupled to the wire wrap 208 on the exterior surface. Such an embodiment may allow the wire wrap 209, 208 to engage each other. Similarly, the rods 210 may be coupled to the wire wrap 208 on the exterior surface of the wire wrap 208. Such an embodiment may allow the rods 210, 211 to provide structure support to the expandable screen 320 while providing a larger flowbore 214 through the expandable screen 320.

Figure 3C:
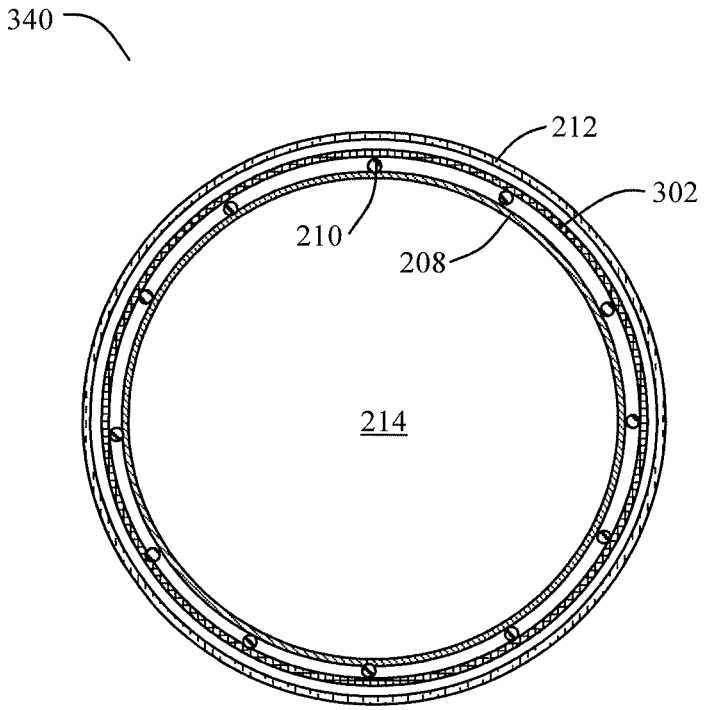
FIG. 3C is still another cross-sectional view of an expandable screen according to an embodiment of the disclosure.

FIG. 3C illustrates a cross-sectional view of another embodiment of an expandable screen 340. The expandable screen 340 is similar in many respects to the expandable screen 300 described above in that the expandable screen 340 comprises an inner wire wrap 208 coupled to a plurality of rods 210, a filter layer 302 disposed about the wire wrap 208, and a shroud 212 disposed about the filter layer 302 and the wire wrap 208. However, the embodiment illustrated in FIG. 3C illustrates the rods 210 coupled to the exterior surface of the wire wrap 208, and the filter layer 302 is disposed about the rods 210. The positioning of the rods 210 on the exterior surface of the wire wrap 208 may provide one or more fluid channels between the filter layer 302 and the wire wrap 208. The fluid channels may allow for axial flow along the wire wrap 208 in the event that the wire wrap 208 is clogged adjacent a portion of the filter layer 302. While only a single filter layer 302 is illustrated, the filter layer 302 may comprise a plurality of material layers, and/or a plurality of filter layers can be used in any arrangement with one or more wire wraps 208 coupled to one or more rods 210.

Figure 4A:
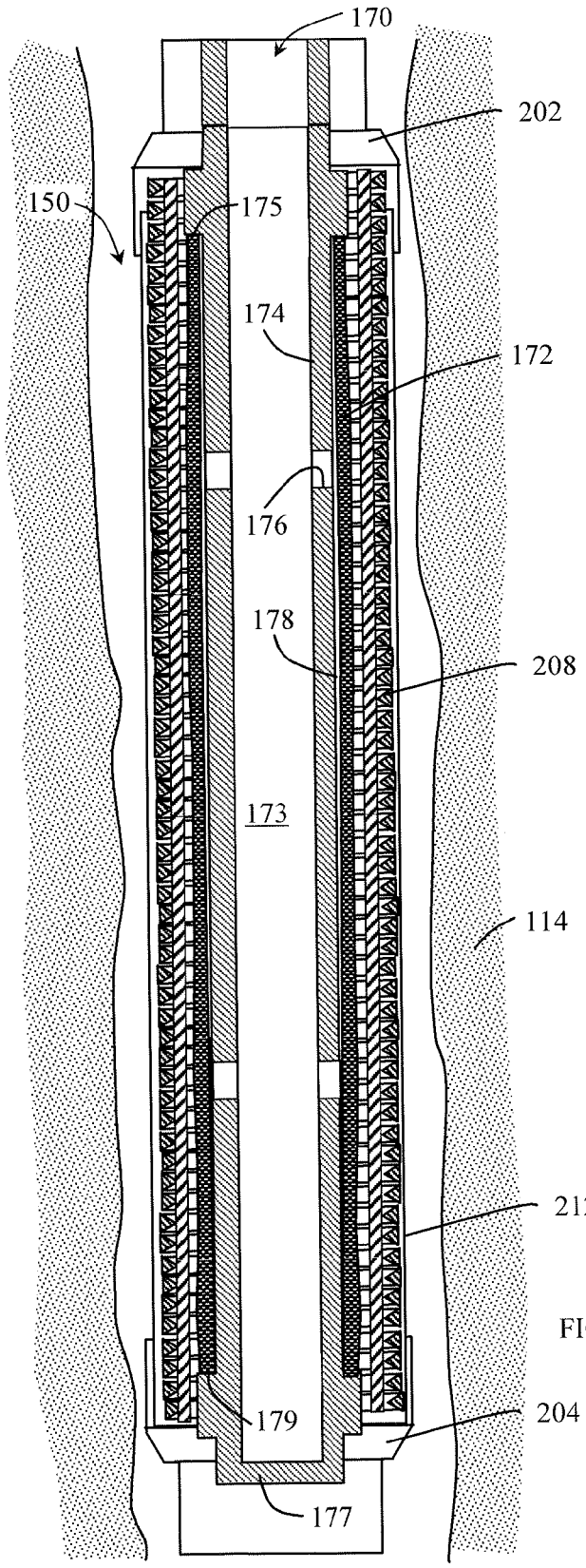
FIG. 4A is a cross-sectional view of an expandable screen and an expansion tool according to an embodiment of the disclosure.

Turning to FIG. 4A, an expansion tool 170 is illustrated within an expandable screen 150 that may comprise an inflatable bladder 172 and a pipe wall 174 having one or more apertures 176. The expansion tool 170 may comprise a coupling structure at one end, for example a threaded pin, for coupling to a tool string. The inflatable bladder 172 may comprise a generally cylindrical component formed of a deformable material (e.g., an elastomer) that sealingly engages the pipe wall 174 at a first end 179 and a second end 176. Further, an end 177 of the expansion tool 170 may be sealed to fluid flow, thereby allowing a fluid pressure to be applied to an interior 173 of the expansion tool 170. The expansion tool 170 and inflatable bladder 172 may be sized to inflate the portion of the expandable screen 150 between the first end 202 and the second end 204 of the expandable screen 150, but not the ends themselves. In this embodiment, the end connections may not comprise expandable components, which may avoid the need for expensive expandable threads and connection materials. In some embodiments, the expansion tool 170 and inflatable bladder 172 may be sized to inflate only a portion of the expandable screen 150 between the first end 202 and the second end 204.

In an embodiment, the expansion tool 170 may be configured to expand the diameter of the expandable screen 150 at least about 1 inches in diameter, at least about 2 inches in diameter, or at least about 3 inches in diameter, but the expansion would generally be less than about 6 inches in diameter. It is contemplated that the expandable screen 150 may not expand uniformly but may expand to conform to an irregularly shaped wall of the wellbore 114. The expandable screen 150 may, in part, act to maintain the integrity of the wellbore 114 and reduce an inclination of the wellbore 114 to crumble, collapse, or break loose. In an embodiment, the expandable screen 150 may allow for the production of fluids from the wellbore 114 and/or subterranean formation 102 without performing a gravel pack procedure.

In use, the expansion tool 170 may be run in the wellbore within a section of expandable screen 150 or the expansion tool 170 may be conveyed into the expandable screen 150 after the expandable screen 150 has been set within the wellbore. Once positioned within an expandable screen 150, fluid pressure may be applied to the interior 173 of the expansion tool 170, and the fluid pressure may be communicated through the apertures 176 to a chamber 178 formed between the interior surface of the inflatable bladder 172 and the exterior surface of the pipe wall 174. When the pressure communicated to the chamber 178 exceeds a pressure differential threshold relative to the pressure outside the inflatable bladder 172, the inflatable bladder 172 may expand and apply an expansion force on the interior surface of the expandable screen 150. The continued application of pressure may result in expanding the expandable screen 150 into contact with the wall of the wellbore 114.

Figure 4B:
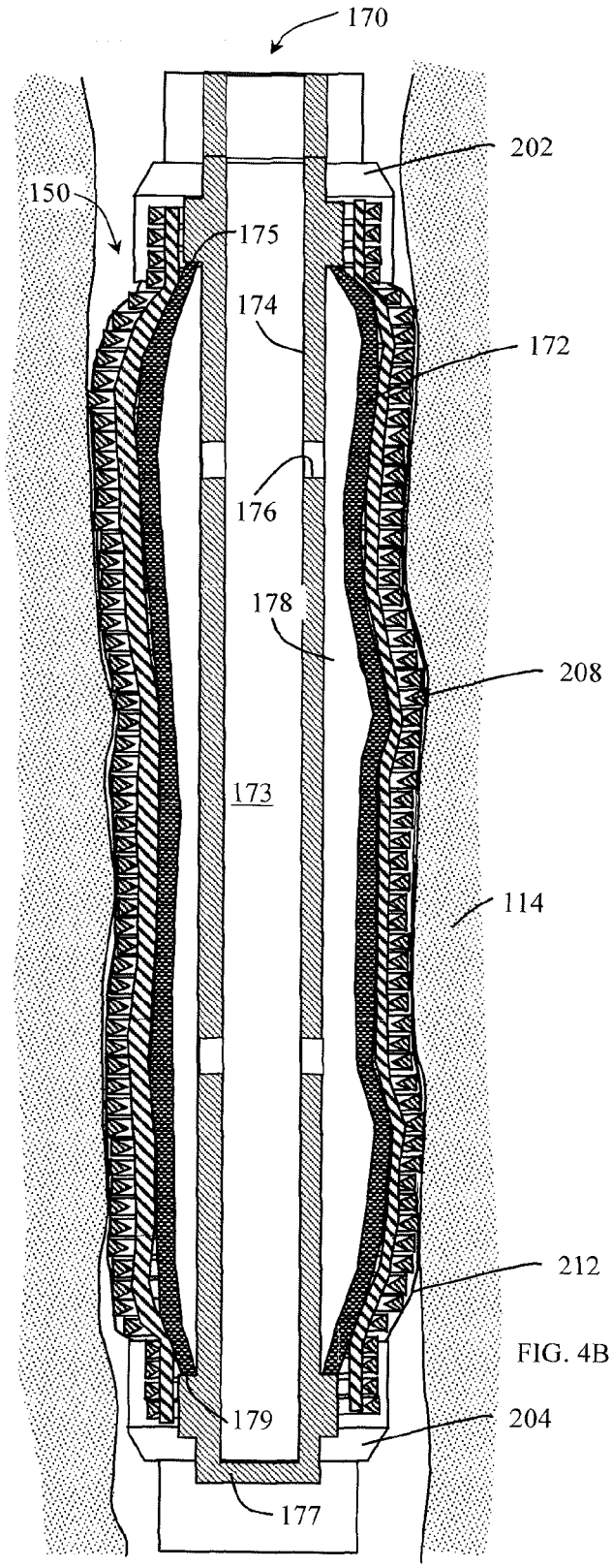
FIG. 4B is another cross-sectional view of an expandable screen and an expansion tool according to an embodiment of the disclosure.

The resulting expanded configuration of the expandable screen 150 and expansion tool 170 may be as shown in FIG. 4B. In this configuration, the inflatable bladder 172 can inflate and expand the expandable screen 150 to conform with the wall of the wellbore 114 proximate to the inflatable bladder 172, which is shown exaggerated in FIG. 4B for the purpose of illustration. As illustrated, the wire wrap 208 may be deformed and expanded outwards to contact the inner surface of the shroud 212, which may be deformed to engage the wall of the wellbore 114 along its length. The rods may also deform to remain coupled to the wire wraps. As illustrated in FIG. 4B, the use of an expandable screen 150 without a base pipe may provide a greater conformance of the screen to the wall of the wellbore 114, shape due to the increased flexibility of the wire wraps 208 relative to a stiffer base pipe. In addition, when the expandable screen 150 is in the expanded configuration, a relatively large interior flowbore 214 may allow for the conveyance of tools through the expandable screen section 150.

Figure 4C:
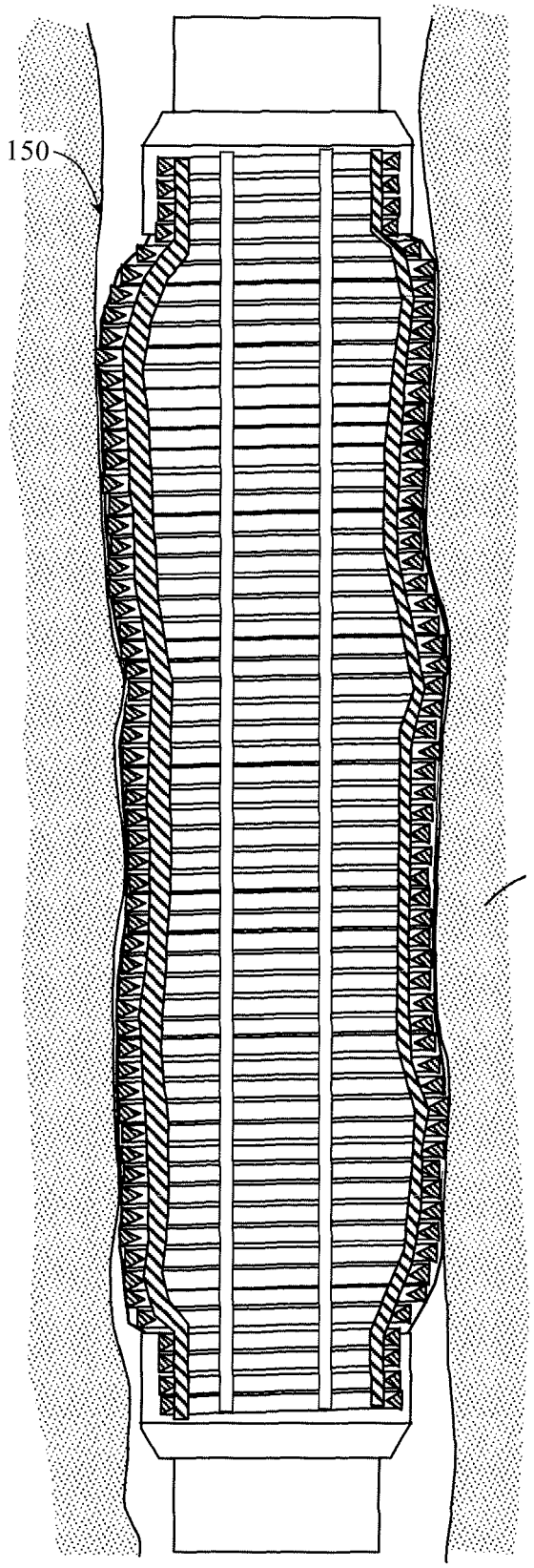
FIG. 4C is a cross-sectional view of an expandable screen according to an embodiment of the disclosure.

Once the expandable screen 150 has been expanded a desired amount, the expansion tool 170 may be deflated and removed from the interior of the expandable screen 150. The configuration of the expandable screen 150 may then be as shown in FIG. 4C. The expansion tool 170 may be moved to another expandable screen 150 section, re-inflated to expand the expandable screen 150 to engage the wall of the wellbore 114, and deflated to remove the expansion tool 170 multiple times to completely expand the expandable screen 150 along the length of the expandable screen 150 string. Fluid may then be produced through one or more sections of the expandable screen 150.

It is contemplated that a variety of embodiments of the expandable screen 150 may benefit from the teachings of the present disclosure, for example, benefit from the omission of a base pipe from the expandable screen 150. A base pipe when perforated for use in an expandable screen may be subject to damage from expansion forces due to the concentration of stresses at the perforations. Additionally, a base pipe when perforated for use in an expandable screen may have only about 5% of its surface area perforated and may be susceptible to scaling problems in some downhole production environments, for example, the perforations in the base pipe may scale and become clogged, thereby decreasing production through the perforated base pipe.

Figure 5:
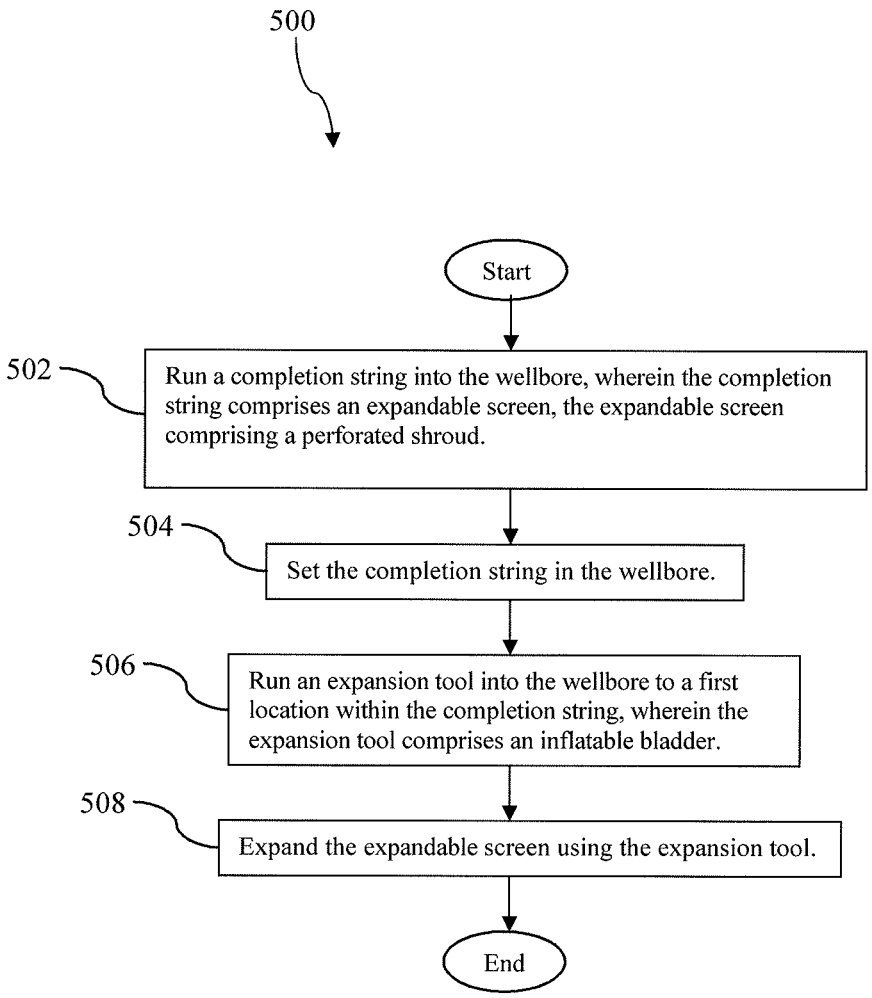
FIG. 5 is a flow chart of a method according to an embodiment of the disclosure.

Turning now to FIG. 5, a method 500 is described. At block 502, a completion string comprising an expandable screen according to any of the embodiments disclosed herein can be run into the wellbore. The expandable screen may comprise a shroud disposed about a wire wrap coupled to one or more rods. At block 504, the completion string may be set in the wellbore, for example, the wellbore tubular string 120 may be set in the wellbore 114. At block 506, an expansion tool may be run into the wellbore to a first location within the completion string, wherein the expansion tool comprises an inflatable bladder. At block 508, the expandable screen may be expanded using the expansion tool. It is understood that the expandable screen may be any of the expandable screens described further above.

Figure 6:
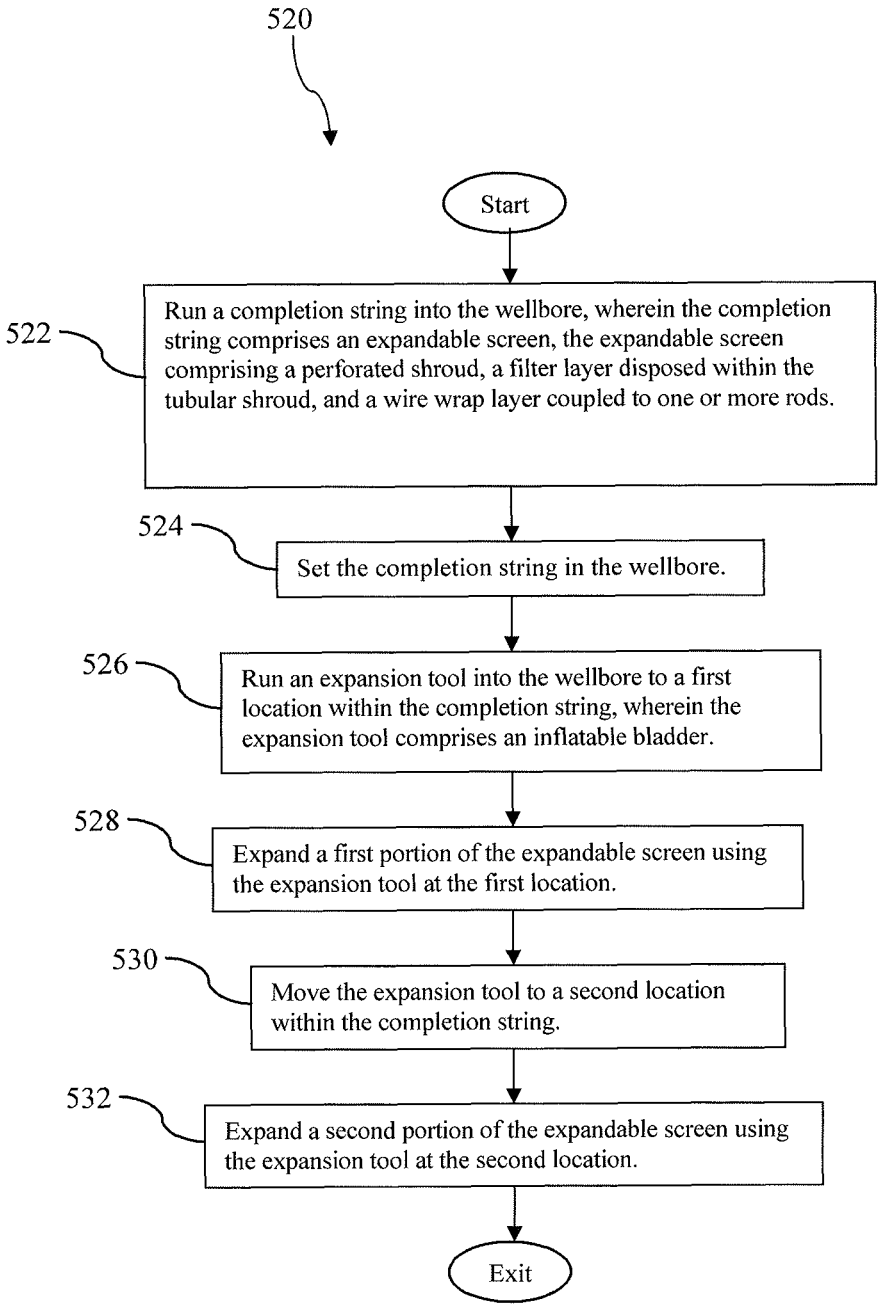
FIG. 6 is a flow chart of another method according to an embodiment of the disclosure.

Turning now to FIG. 6, a method 520 is described. At block 522, a completion string may be run into the wellbore, wherein the completion string comprises an expandable screen and the expandable screen may comprise a shroud, a filter layer disposed within the tubular shroud, and a wire wrap coupled to one or more rods. At block 524, the completion string may be set in the wellbore, for example, the wellbore tubular string 120 may be set in the wellbore 114. At block 526, an expansion tool may be run into the wellbore to a first location within the completion string, wherein the expansion tool comprises an inflatable bladder. At block 528, a first portion of the expandable screen may be expanded using the expansion tool at the first location. At block 530, the expansion tool may be moved or conveyed to a second location within the completion string. At block 532, a second portion of the expandable screen may be expanded using the expansion tool at the second location. It is understood that the expandable screen may be any of the expandable screens described further above.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An expandable screen comprising:

a first end comprising a first coupling mechanism;

a second end comprising a second coupling mechanism;

a wire wrap section having a cylindrical structure extending between the first end and the second end, wherein the wire wrap section is coupled to the first and the second end, wherein the wire wrap section is configured to radially expand, and wherein the wire wrap section is open to fluid flow through the wire wrap section along all portions of the circumference of the wire wrap section; and a plurality of rods coupled directly to the wire wrap section, wherein the plurality of rods is configured to maintain an annular space between the wire wrap section and an adjacent layer of the expandable screen upon radial expansion of the wire wrap section and to provide structural support against axial tension and compression loads on the expandable screen;

wherein the wire wrap section and the plurality of rods are configured to provide structural integrity to the expandable screen without the use of a base pipe positioned within an inner diameter of the wire wrap section.

2. The expandable screen of claim 1, further comprising a filter layer disposed about the wire wrap section.

3. The expandable screen of claim 2, wherein the plurality of rods are disposed between the wire wrap section and the filter layer to maintain the annular space between the wire wrap section and the filter layer.

4. The expandable screen of claim 1, further comprising a shroud disposed about the wire wrap section.

5. The expandable screen of claim 1, wherein the plurality of rods is coupled to an outer surface of the wire wrap section.

6. The expandable screen of claim 1, further comprising:

a second wire wrap section disposed within the wire wrap section; and a second plurality of rods coupled directly to the second wire wrap section;

wherein the plurality of rods coupled to the wire wrap section is configured to maintain the annular space between the wire wrap section and the second wire wrap section.

7. The expandable screen of claim 6, further comprising a filter layer disposed between the wire wrap section and the second wire wrap section.

8. The expandable screen of claim 6, wherein each one of the plurality of rods is spaced circumferentially along the wire wrap section and aligned with a respective one of the second plurality of rods spaced circumferentially along the second wire wrap section.

9. The expandable screen of claim 1, wherein the plurality of rods extends longitudinally along a surface of the wire wrap section.

10. An expandable screen comprising:

a first end;

a second end; and a screen section coupled to the first end and the second end and having a cylindrical structure, wherein the screen section comprises a wire wrap and a plurality of rods coupled directly to the wire wrap, wherein the screen section is configured to expand in response to an outward directed force exerted on an interior of the screen section, wherein the wire wrap is open to fluid flow through the wire wrap along all portions of the circumference of the wire wrap, and wherein the plurality of rods is configured to provide structural support against axial tension and compression loads on the expandable screen and to maintain an annular space between the wire wrap and an adjacent layer of the screen section upon radial expansion of the screen section to facilitate an axial flow of fluid through the annular space.

11. The expandable screen of claim 10, wherein the screen section comprises an interior flowbore, and wherein the interior flowbore is configured to receive an expansion tool.

12. The expandable screen of claim 10, further comprising a filter layer disposed about the screen section, wherein the filter layer is configured to expand with the screen section.

13. The expandable screen of claim 10, further comprising a shroud disposed about the screen section, wherein the shroud is configured to expand with the screen section.

14. A method of expanding an expandable screen in a wellbore, comprising:

disposing an expansion tool into an interior flowbore of an expandable screen, wherein the expandable screen comprises:

a first end;

a second end; and a screen section coupled to the first end and the second end, wherein the expandable screen comprises a wire wrap having a cylindrical structure and a plurality of rods coupled directly to the wire wrap, wherein the wire wrap is open to fluid flow through the wire wrap along all portions of the circumference of the wire wrap;

providing structural support to the expandable screen via the wire wrap and the plurality of rods without the use of a base pipe positioned within an inner diameter of the wire wrap;

providing an outward directed force on the interior of the screen section using the expansion tool;

radially expanding the screen section in response to the outward directed force; and maintaining an annular space between the wire wrap and an adjacent layer of the expandable screen via the plurality of rods to enable an axial flow of fluid through the annular space.

15. The method of claim 14, wherein radially expanding the screen section comprises expanding the screen section to conform to a wellbore wall proximate to the expandable screen.

16. The method of claim 14, wherein expanding the screen section comprises expanding the outside diameter of the expandable screen to contact a wellbore wall.

17. The method of claim 14, further comprising:

moving the expansion tool to a second interior flowbore of a second expandable screen; and expanding a second expandable screen using the expansion tool.

18. The method of claim 14, further comprising removing the expansion tool from the wellbore while leaving the radially expanded screen section in place in the wellbore.

19. The method of claim 14, wherein the expansion tool comprises an expandable bladder, and wherein providing the outward directed force comprises increasing the pressure within the expansion tool, and expanding the expandable bladder into contact with the interior of the screen section.

20. The method of claim 14, further comprising filtering a fluid through the screen section after radially expanding the screen section.

* * * * *